United States Patent [19]

Teng

[11] Patent Number: 4,498,548

[45] Date of Patent: Feb. 12, 1985

[54] WELL JAR INCORPORATING ELONGATE RESILIENT VIBRATION SNUBBERS AND MOUNTING APPARATUS THEREFOR

[75] Inventor: Chuan C. Teng, Houston, Tex.

[73] Assignee: Dailey Petroleum Services Corp., Conroe, Tex.

[21] Appl. No.: 505,981

[22] Filed: Jun. 20, 1983

[51] Int. Cl.[3] ..... E21B 31/107

[52] U.S. Cl. ..... 175/299; 175/321; 166/178; 29/402.08; 464/20; 308/4 A

[58] Field of Search ..... 175/299, 293, 305, 321, 175/406, 407, 325; 166/178; 308/4 A, 4 R, 3 R; 464/67, 83, 20; 267/134; 188/67, 83; 76/108 A, 101 E; 29/402.08, 402.12

[56] References Cited

U.S. PATENT DOCUMENTS

| | | | |
|---|---|---|---|
| 2,023,266 | 12/1935 | Davis | 308/4 A |
| 3,115,696 | 12/1963 | Evans | 308/3 R |
| 3,208,541 | 9/1965 | Lawrence | 175/299 |
| 3,225,844 | 12/1965 | Roberts | 175/325 |
| 3,233,690 | 2/1966 | Lawrence | 175/320 |
| 4,064,730 | 12/1977 | Gerretz | 308/3 R |
| 4,394,883 | 7/1983 | Briscoe | 175/304 |

*Primary Examiner*—Stephen J. Novosad
*Assistant Examiner*—Mark J. DelSignore
*Attorney, Agent, or Firm*—Gunn, Lee & Jackson

[57] ABSTRACT

For use in a well jar, a mounting apparatus for resilient elongate snubbers is described. In the preferred and illustrated embodiment, parallel elongate resilient snubbers are formed on metallic backing strips. They are profiled to define sloping elongate sides which slidably fit within undercut grooves. The undercut grooves extend from an encircling shoulder to enable easy insertion into the grooves. The shoulder is adjacent to an encircling narrow neck, thereby enabling an expandable lock ring to be positioned in the neck, securing the resilient snubbers in position.

17 Claims, 7 Drawing Figures

FIG. 1
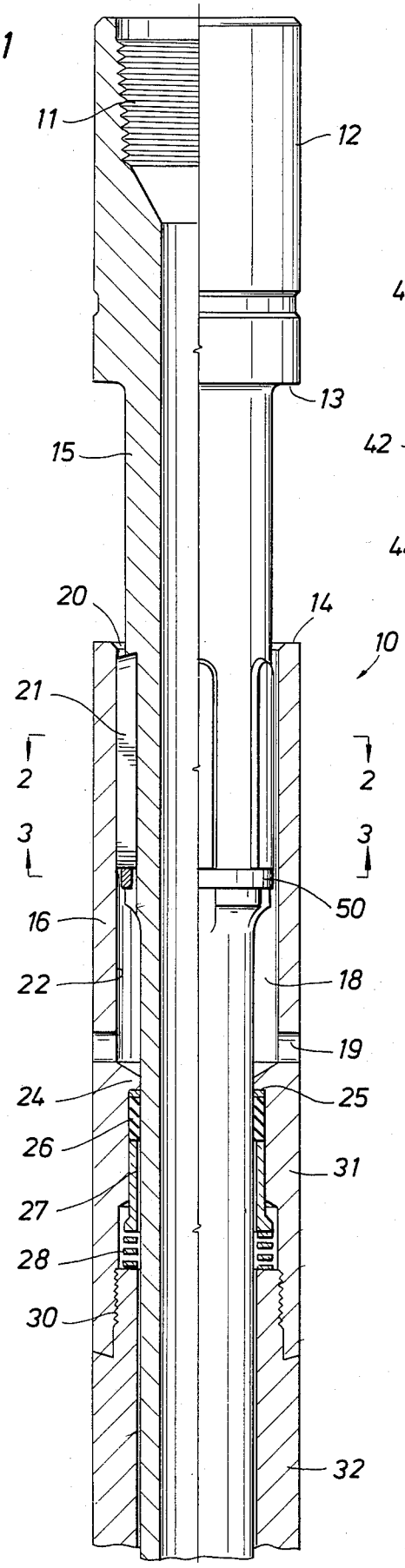
FIG. 2
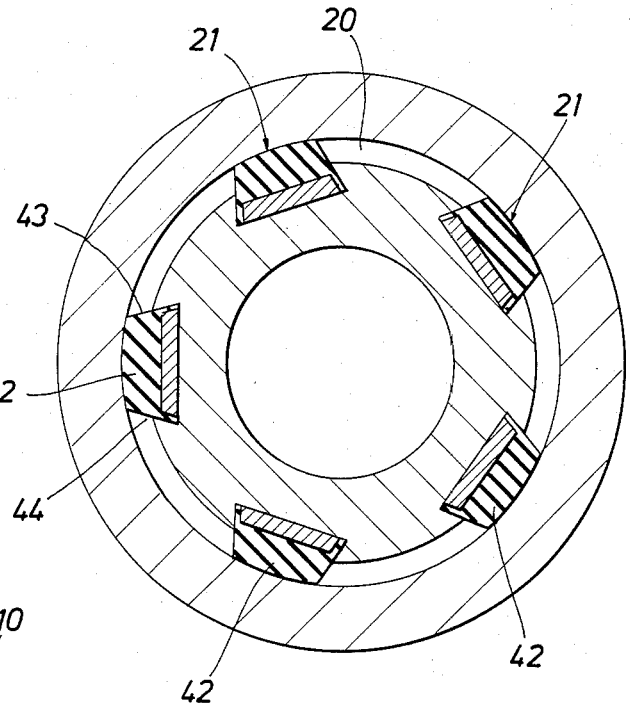
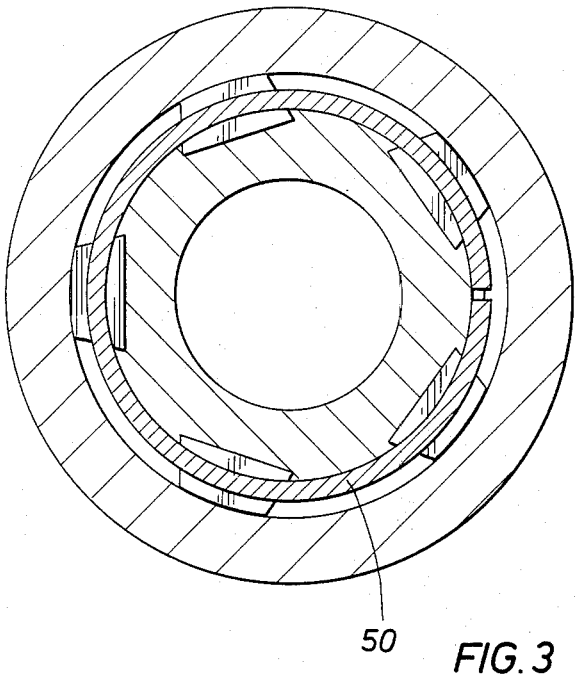
FIG. 3

FIG. 4
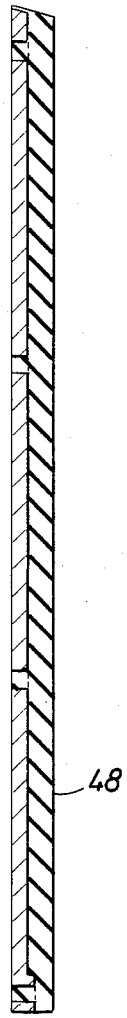
FIG. 5
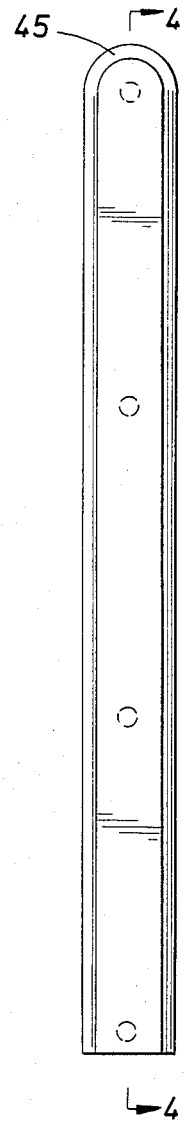
FIG. 6
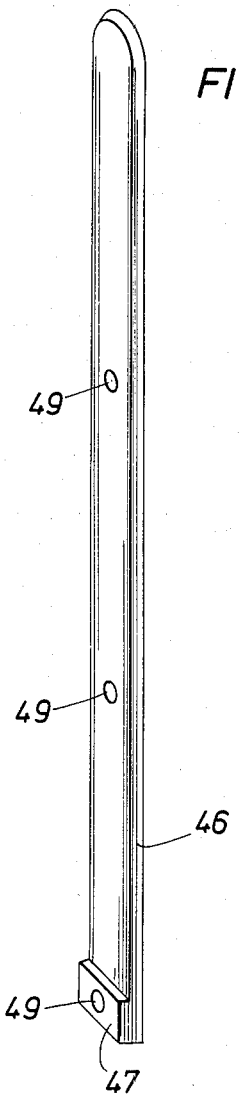
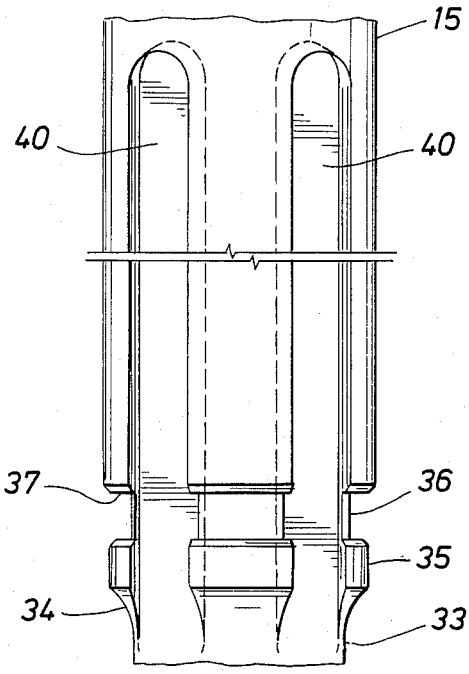
FIG. 7

WELL JAR INCORPORATING ELONGATE RESILIENT VIBRATION SNUBBERS AND MOUNTING APPARATUS THEREFOR

BACKGROUND OF THE DISCLOSURE

A rotary drilling jar is set forth in earlier U.S. Pat. Nos. 3,208,541 and 3,233,690 issued to Richard R. Lawrence. The rotary drilling jar set forth in those patents has met with substantial acceptance around the world. It is a jar which is typically installed in a drill stem normally incorporating a drill bit at the bottom, various drill collars thereabove, stabilizers as necessary, and a plurality of drill pipe to extend from the kelly at the derrick to the bottom of the borehole. Typically, the drill stem includes the drill bit at the bottom with several collars or stabilizers or both just above the drill bit. In typical operations, the drill pipe is substantially smaller in diameter than the drill collars. As an example, 8 inch drill collars may be mounted above a drill bit of 9½ inches, and the remainder of the distance to the derrick will be fabricated from a string of 4½ inch diameter drill pipe. The drill stem is filled with drilling mud of substantial weight. The weight on bit may readily approach 100,000 pounds in a well of about 15,000 feet. The drill stem is normally rotated at a speed of about 35 to 150 rpm by a rotary table engaging the kelly, a non-round member of the drill stem.

In a drill stem of this typical size, it is possible for the drill bit to drill a crooked hole, thereby forcing the drill collars just above the bit against the side wall. It is possible to stick the drill stem. If sticking occurs, it typically happens near the drill collars where they keyseat the crooked hole and are held against the side wall of the hole. When the drill stem is stuck, it is possible to lose a part of the drill stem by twisting off at some point above the point where sticking occurred, necessitating a fishing job to clear the borehole of the broken drill stem.

To prevent the foregoing, it is appropriate to incorporate a drilling jar typified by this disclosure in the drill stem at the lower end of the drill pipe and just above the drill collars and stabilizers or partially below the drill collar. A drilling jar is typically included; this is a device which can be latched and then released to enable its components to telescope. On actuation, components known as a hammer and anvil are struck together to deliver a jar or jolt to the drill stem. This hammering action can be controlled and occurs upwardly or downwardly. It is intended to break the stuck drill stem free at the place where it is stuck.

The rotary drilling jar, when operated, is moved in a telescoping fashion. It is exposed to drilling mud. Drilling mud is a liquid weight material pumped through the drill stem and returned on the annular space on the exterior. Small particles of drilled formation debris and the like are carried in the annular space. Conventional rotary drilling jars are normally secured together by means of a latch mechanism between the major components of the drilling jar. Pressures in the vicinity of the drilling jar are quite high, typically in the range of 1,500–5,000 psi. Drilling jars constructed in accordance with the teachings of the two mentioned United States patents have an annular cavity within. This cavity is filled with drilling mud in ordinary operation. The mud is laden with particulate trash which will abrade and damage the drilling jar. The references mentioned above disclose encircling rings which define the annular cavity or chamber within the drilling jar. As the jar is axially operated, this chamber or cavity is changed in size. This requires the drilling mud to flow quickly into or out of the chamber, depending on the direction of stroke. This annular chamber, defined at one end by encircling resilient rings, operates as a fluid damping chamber. This may slow down operation of the tool.

As set forth in application Ser. No. 203,527 which was filed Nov. 3, 1980, now issued and bearing U.S. Pat. No. 4,394,883, resilient parallel snubbers are shown. The snubbers enlarge the narrow passage into or out of the annular cavity or chamber. Several parallel resilient snubbers are installed as set forth in that patent, thereby permitting more rapid flow through the narrowed passage. The flow characteristic is improved; additionally, the resilient snubbers improve damping of vibration. It will be understood that the climate where the drilling jar is used is extremely hostile. This is all the more so in light of the fact that recent wells are deeper, thereby placing greater loads on the drill stem. Elongate parallel vibration dampers are set forth in the referenced patent. They are mounted with a plurality of screws. It is important to mount them in fixed fashion, a set of such resilient vibration dampers protecting the reciprocating components of the drilling jar. However, servicing limitations and the time required to assemble or disassemble such vibration dampers make the construction of this disclosure quite attractive. This construction enables the vibration dampers to be mounted individually and with great ease and facility. They are installed in undercut grooves. This enables several to be installed quickly, all terminating at the end of the respective grooves in which they are positioned. Moreover, they are well fastened, secured, and not readily torn free by the vigorous use that is inevitably encountered. An entire set of vibration dampers can be removed and replaced with a new set of vibration dampers in quick order through the use of the present invention.

This invention is a improvement over the structure shown in the referenced patent. It is an improvement in that it enables the vibration dampers to be installed quickly and easily and with greater certainty. Hand labor is reduced. The risk of stripping threads is eliminated.

From the foregoing, the present disclosure is summarized as a device enabling the mounting and demounting of plurality of parallel resilient vibration dampers in undercut grooves. All the grooves are parallel to one another, extending from a neck of reduced diameter to enable easy insertion. The neck fully encircles the device, thereby receiving a C-shaped lock ring which is spread by means of a tapered surface immediately adjacent to the neck. The lock ring secures the resilient dampers in position.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a lengthwise sectional view of the upper portions of a jar showing barrel and mandrel and illustrating an internal chamber apt to be filled with drilling fluid, the fluid flowing out past a set of parallel longitudinal vibration dampers;

FIG. 2 is a sectional view along the line 2—2 of FIG. 1 showing details of construction of the undercut grooves which receive and support the vibration dampers;

FIG. 3 is a view along the line 3—3 of FIG. 1 showing the ends of the vibration dampers arranged adjacent to a C-shaped lock ring;

FIG. 4 is a detailed view in section of a single elongate resilient damper showing a metal backing beneath a resilient cover;

FIG. 5 is a plan view of the damper shown in FIG. 4;

FIG. 6 is a view of the metal backing of the damper shown in FIGS. 4 and 5 omitting the resilient covering thereon; and FIG. 7 shows the grooves for receiving the resilient snubbers extending from a narrow neck for receiving the lock ring.

DETAILED DESCRIPTION OF THE PREFERRED EMBODIMENT

Attention is first directed to FIG. 1 of the drawings where a drilling jar is indicated generally by the numeral 10. The entirety of the jar is not illustrated; lower portions of the jar can be constructed in the manner set forth in the referenced Lawrence patents. Another jar is shown in recently issued U.S. Pat. No. 4,394,883 of Briscoe. The structure of FIG. 1 provides the context for the improved resilient snubbers of the present disclosure. Proceeding from the upper end of FIG. 1, there it will be observed a threaded box 11 connects in a drill stem. This locates the drilling jar 10 in the drilling stem; the preferred location is at the top of the drill collars. Other locations quite obviously can be used. There is a connective pin at the lower end of the drilling jar 10, the pin and box being connected to define an axial flow path through the drill stem. They are constructed in accordance with industry standards.

FIG. 1 further shows the box 11 being constructed in an enlargement which is described hereinafter as the hammer 12. The hammer has a downwardly facing circumferential shoulder 13. It confronts a matching shoulder 14. The shoulders 13 and 14 are telescoped together to impact, thereby creating a downward jarring force. Jarring in the upward stroke is also permissible at another pair of opposing shoulders (not shown). The enlargement 12 which functions as a hammer is affixed to a central mandrel 15. The mandrel 15 extends axially on the interior of a surrounding barrel 16. The barrel 16 fits around the mandrel 15 for telescoping movement. This movement enables hammering to be accomplished for operation of the drilling jar 10.

The barrel 16 supports the upwardly facing shoulder 14. That shoulder is at the top end of a annular chamber 18. The chamber 18 drains to the exterior through a port 19. The port is located at the lower end of the chamber 18 and is repeated at six locations around the periphery of the barrel. There is an interrupted annular flow space 20. The annular flow space is on the interior of the barrel 16 and proceeds past a set of several removable snubbers 21. They will be described in greater detail hereinafter. The snubbers are able to slide within the chamber 18 with the downward movement of the control mandrel 15. They are installed to contact the inner surface 22 on the interior of the barrel 16. This surface is a guide surface working against the snubbers, the snubbers supporting the barrel and mandrel in telescoping relationship permitting lengthwise movement. Rotational movement is also permitted. However, the snubbers achieve an alignment which forbids canted movement. The snubbers are incorporated to absorb impact and permit relatively easy movement. They are also included to transfer lateral thrust or shock loading. They are also included to dampen any lateral loading vibrations. Moreover, the several snubbers are arranged in a circumferential spaced sequence which assures damping of lateral vibrations in all directions.

The mandrel 15 is centered within the chamber 18 to define an internal volume. This volume varies depending on the position of the components as shown in FIG. 1. When it is filled with drilling fluid, that fluid must flow out of the chamber 18. Gaps are arranged between the snubbers 21 to define a cumulative flow path out of the chamber 18, the path being sufficiently large that rapid flow of the drilling mud out of the chamber 18 is accomplished. The chamber 18 is a relatively large chamber which must be evacuated on stroking the components of the tool to create an impact. As drilling mud flows through the gaps, movement of the tool in the intended fashion is permitted. This stroke forces some of the drilling mud and mud supported particulates through the gap adjacent to the snubbers. The relative cross sectional area of that gap is sufficiently large that rapid evacuation of the chamber 18 does occur.

Just below the bleed holes 19, there is an internal shoulder 24 circumferentially about the mandrel 15. It protrudes inwardly. The shoulder 24 is immediately adjacent to a packing ring 25. That ring supports a resilient packing 26. In turn, a packing sleeve 27 is just below, and the sleeve 27 is forced upwardly by a compressed coil spring 28. The spring 28 loads the packing 26 and forces it to expand into sealing contact around the mandrel 15. The packing is located immediately above a threaded joint 30 which enables the barrel 16 to be divided into portions. The upper portion is located above the thread 30 and is identified at 31. It joins to a lower portion 32, the two threaded portions joining to thereby define an internal cavity for receiving the coil spring 28 and the various members which make up the packing shown in FIG. 1.

Attention is momentarily directed to FIG. 7 of the drawings where the mandrel 15 is shown with a portion broken away for sake of clarity. It includes a relatively narrow neck 33 at the lower end. The neck 33 is flaired into an expanding tapered face 34, the face 34 terminating below an enlargement ring 35 constructed integrally with the mandrel. The shoulder or ring 35 is immediately adjacent to a groove 36. The groove 36 is defined by opposing or facing shoulders, one being the downwardly facing shoulder 37. The shoulder 37 confines a C-shaped lock ring as will described. The shoulder 37 is interrupted by undercut grooves 40 which are included for the purpose of supporting and receiving parallel resilient snubbers constructed in accordance with the teachings of this disclosure.

Returning now to FIG. 2 of the drawings, several resilient snubbers 21 are shown installed. The snubbers 21 are constructed with tapered side walls. That is, the snubbers 21 shown in FIG. 2 have side walls 43 and 44. The walls 43 and 44 are parallel to one another along their length. They taper toward one another to define a truncated cross section. The lengthwise grooves 40 thus receive and support the snubbers 21 which are locked in place by means of the undercuts. As will be noted on reviewing FIG. 7, all the grooves are undercut. They are undercut to lock the inserted snubbers in location, thereby securing the snubbers in a state of readiness for use.

Each snubber 21 is inserted into the prepared groove 40. The side walls of the groove are undercut thereby defining a narrow slat which prevents the snubber from dropping out. That is, FIG. 2 shows the undercut whereby the snubbers are held in a locked condition. The taper in the grooves 40 assures that the snubbers are held in position after installation.

Turning now to FIGS. 4, 5 and 6, it will be observed that each snubber is made on a metal backing 46. The metal backing 46 terminates at the curved end 45 previously mentioned. The metal backing includes an enlarged step 47. A resilient coating 42 is placed over the top. The resilient coating adhers to the surface. In addition, there are small drilled holes 49 at various locations. The resilient material 42 anchors in the small drilled holes. This helps fasten the resilient material in place. The resilient material is preferably polyurethane or some other polyalefin coating. It is relatively hard, having a hardness of about 60–90 durometer. It is constructed as an upstanding curved arcuate top surface 48 as better shown in FIG. 2. There, the resilient material is confined. It is preferably made slightly tall so as to achieve an interference fit when the several snubbers are installed in the respective grooves. The snubbers are sized with a view of filling the grooves completely and standing sufficiently tall to define the annular flow space 20. The annular space 20 is thus broken up into several flow cavities or passages as shown in FIG. 2. In FIG. 2, there are five channels 20 which collectively conduct mud flowing from the chamber 18.

The ring 35 shown in FIG. 7 is interrupted at each longitudinal groove. This enables each snubber to slide along the mandrel 15 as it is inserted into the undercut groove. They are inserted with the curved tip 45 being first inserted, and the tip 45 seats in the curvature at the end. The snubbers are slidably mounted by moving them upwardly into the respective grooves. When all have been placed in position, they terminate more or less even with the shoulder 37. This leaves the groove 36 clear. The groove 36 is clear to receive a C ring 50. The ring 50 is a ring which is moved over the mandrel 15 by sliding up the mandrel. The ring 50 is in the form of a C; it is interrupted with a cut to permit flexure as the ring is enlarged. The ring enlarges as it slides up the tapered face 34. The tapered face 34 enables the ring to be passed over the enlargement 35. The ring is forced upwardly and falls into the groove 36, snapping to a smaller diameter. The ring is a lock ring which blocks every one of the snubbers. They have a length which enables all of the snubbers to be blocked adjacent to the ring, thereby locking the several snubbers in position.

Several advantages of the present apparatus should be considered. At the time of installation, the snubbers are easily placed in the respective grooves. This is accomplished at a time when the mandrel 15 is pulled substantially free of the barrel 16. The snubbers are inserted and are nested neatly at the circular tip of the grooves 40. After they have been positioned in the grooves, the lock ring 50 is then moved up the mandrel 15. When the enlargement at 35 is encountered, sizeable force is applied to expand the ring 50. As shown in FIG. 3 of the drawings, the ring eventually is pushed over the enlargement 35 and falls to the narrow neck or groove. When it is in that position, it is sufficiently smaller that it secures all the snubbers in location. When this occurs, the entire snubber system is then ready for installation on the interior of the barrel 16.

The cumulative annular flow capacity of passages 20 is sufficiently large that the hammer and anvil arrangement is able to travel at rapid speed to impact. Movement is not damped by the accumulation of fluid in the chamber 18. Rather, high speed opening and closing is permitted. This flow into and out of the chamber 18 has a distinct advantage in that it is not restricted and does not damp movement of the components of the drilling jar 10.

The snubbers are sacrifical devices. They tend to wear out. They can be replaced by separating or exposing the area where the snubbers are locating. Referring to FIG. 1 of the drawings, this requires that the mandrel 15 be relatively raised to expose the snubbers and the C ring 50. The ring 50 can then be removed by expanding the ring 50 with suitable tools. As it is expanded, it is enlarged thereby enabling the ring to ride over the enlargement 35 and then on to the other surface 33 shown in FIG. 7. One or more new snubbers can be installed after removing the worn snubbers. As a convenience, it is desirable to replace the whole set to maintain centralized positioning of the mandrel 15 within the barrel 16.

Periodically, the snubbers are thus serviced by replacement. When they are first installed, they tend to achieve an interference fit. To this end, the shoulder 14 surrounds an internal chamfer which enables the snubbers to be easily inserted without tearing. Moreover, they are inserted and smoothly received against the interior surface 22 defining the chamber 18. At this juncture, they can be used indefinitely until the next replacement is required.

While the foregoing is directed to the preferred embodiment, the scope thereof is determined by the claims which follow.

What is claimed is:

1. A rotary well jar subject to severe lateral and longitudinal drill string forces in a fluid-filled wellbore wherein the well jar has an elongate body with an axial passageway for fluid flow, the body having threaded connections at its ends for assembly in a string of pipe, the body having an annulus exposed to well fluid between a mandrel and barrel, the annulus defining an elongate fluid receiving chamber and wherein an impact between hammer and anvil surfaces on the mandrel and barrel jars the pipe, the rotary well jar comprising:

(a) a plurality of elongate resilient vibration snubbers supported externally of said mandrel at an upper end of said annulus and internally of said barrel;

(b) longitudinal groove means receiving said snubbers and said groove means are undercut to define a locking means securing said snubbers therein after insertion and said groove means terminate at a narrow neck;

(c) said snubbers slidably engaging between said barrel and said mandrel through relative telescoping movement;

(d) said snubbers disposed in circumferential spaced relationship about said annulus forming flow channels therebetween in said annulus; and (e) said snubbers having an exposed surface for engaging a surrounding inner surface to dampen vibration and permit telescoping movements between said mandrel and said body.

2. The apparatus of claim 1 wherein said groove means comprise grooves formed in said mandrel;

(a) said grooves being registered relative to an encircling shoulder adjacent to said neck about said mandrel; and (b) said grooves enabling said snubbers to be inserted lenthwise thereinto.

3. The apparatus of claim 1 wherein said snubbers, when positioned in said groove means collectively define an interference fit in said annulus.

4. The apparatus of claim 1 wherein said narrow neck is defined between a pair of spaced, facing shoulders, and said shoulders receive therebetween an expandable locking ring comprising said locking means.

5. The apparatus of claim 4 including a tapered, enlarging surface adjacent to said narrow neck to enable said locking means to slide along said surface for enlarging prior to positioning in said narrow neck.

6. The apparatus of claim 5 wherein said shoulders defining said narrow neck are interrupted at spaced locations with said groove means to enable relative longitudinal assembly of said snubbers into said groove means.

7. The apparatus of claim 1 wherein said groove means are formed of lengthwise facing walls, and said walls are angularly disposed to one another defining a more narrow spacing at the top of said groove means, and said groove means are wider at the bottom thereof.

8. The apparatus of claim 7 wherein said groove means end at an encircling circumferential shoulder.

9. The apparatus of claim 1 wherein said snubbers are formed of an elongate metal backing supporting a sacrifical resilient strip joined thereto, and said strip has an exposed outer face more narrow than said metal backing.

10. The apparatus of claim 9 including resilient material along opposing sides of said metal backing.

11. A method of servicing a rotary well jar having an elongate body with an axial passageway from end to end for fluid flow, the body having threaded connections at its ends for assembly into a string of well pipe, the body formed of a barrel and mandrel defining an annulus exposed to well fluid between the mandrel and barrel, and the well jar operates to form an impact between hammer and anvil surfaces on the mandrel and barrel, and the well jar further including a plurality of groove mounted resilient vibration snubbers longitudinally and circumferentially at an upper end of said annulus to slidably enable telescoping movement between said mandrel and said barrel said snubbers forming flow channels therebetween in said annulus to accomodate well fluid flow in said annulus, the method comprising the steps of:

(a) exposing said snubbers for access thereto;

(b) slidably removing and replacing selected ones of said snubbers in grooves with new snubbers at the same relative locations;

(c) placing said mandrel and said barrel in an operative position relative to one another;

(d) locking said snubbers in place in said grooves by shaping said grooves with an undercut along the length thereof, to receive and lock said snubbers against removal radially outwardly; and (e) further locking said snubbers against sliding removal from said grooves by positioning an abutting locking means against a plurality of said snubbers.

12. The method of claim 11 including the step of disassembling said barrel and mandrel prior to removing selected ones of said snubbers.

13. The method of claim 11 wherein the step of replacing selected snubbers includes mounting new snubbers having a size creating an interference fit of said new snubbers on placing said mandrel and barrel in an operative position relative to one another.

14. The method of claim 11 wherein all of said snubbers are removed and replaced with new snubbers.

15. The method of claim 11 wherein said snubbers are elongate resilient strips having an exposed outer face, and said outer face bears against a confining surface with contact on the exposed outer face in an interference fit.

16. The method of claim 11 further wherein the step of removing an old snubber and replacing the old snubber with a new snubber includes demounting and mounting resilient material snubbers held in location by a circular lock ring.

17. The method of claim 11 further wherein said new snubbers include:

(a) an elongate metal base;

(b) an elongate body of resilient material bonded to said base;

(c) said base carrying means for slidably axially engaging a locking groove;

(d) said body having an exposed surface opposite said base;

(e) said resilient material having a resiliency sufficient for dampening lateral and vibrational movements between said mandrel and barrel; and (f) said resilient material being adapted to define an interference fit when mounted for positioning in said annulus in a well jar.

* * * * *